US005685523A

United States Patent [19]

Sugiyama

[11] Patent Number: 5,685,523

[45] Date of Patent: Nov. 11, 1997

[54] OUTDOOR STRUCTURE SUCH AS GATE POST, GATE WING OR FENCE

[75] Inventor: Shigeyuki Sugiyama, Negano-Ken, Japan

[73] Assignee: Toyo Exterior Co., Ltd., Tokyo, Japan

[21] Appl. No.: 579,875

[22] Filed: Dec. 28, 1995

[30] Foreign Application Priority Data

Dec. 30, 1994 [JP] Japan ..... 339569

[51] Int. Cl.[6] ..... E04H 17/16

[52] U.S. Cl. ..... 256/19; 256/24; 256/73; 52/314

[58] Field of Search ..... 256/19, 25, 24, 256/73, 1; 52/511, 314, 386, 387; 403/298

[56] References Cited

U.S. PATENT DOCUMENTS

| | | | |
|---|---|---|---|
| 2,114,451 | 4/1938 | Mattes | 52/314 |
| 2,317,231 | 4/1943 | Swedman | 403/298 X |
| 3,298,668 | 1/1967 | Schueren | 256/19 |
| 3,304,673 | 2/1967 | Ramoneda | 52/314 X |
| 3,600,864 | 8/1971 | Godley et al. | 52/314 X |
| 3,701,228 | 10/1972 | Taylor | 52/386 X |
| 4,644,719 | 2/1987 | Salazar | 52/314 X |
| 4,809,470 | 3/1989 | Bauer et al. | 52/387 X |
| 4,899,513 | 2/1990 | Morris | 52/511 |
| 4,920,716 | 5/1990 | Coffey | 52/387 X |
| 5,228,857 | 7/1993 | Roland | 52/314 X |
| 5,228,937 | 7/1993 | Passeno | 52/387 X |
| 5,373,676 | 12/1994 | Francis et al. | 52/387 |
| 5,421,558 | 6/1995 | Vesper | 256/24 X |

*Primary Examiner*—Harry C. Kim
*Attorney, Agent, or Firm*—Ladas & Parry

[57] ABSTRACT

The invention aims to make outdoor structure such as gate post suitable for mass production by achieving weight reduction of such structure so that the structure can be manually transported, installed, on one hand, and by facilitating adhesive fixation of artificial stones, on the other hand. A substrate of the structure is molded from foam plastics and a nail is partly embedded in each artificial stone during a process of molding this stone so that the nail may partly project out from the rear surface of the artificial stone. Adhesive mortar is applied to the substrate and/or the artificial stone and then the artificial stone is pressed against the substrate so that the nail may penetrate the substrate and thereby the artificial stone may be adhesively fixed. In this manner, the structure is effectively weight-reduced and the nail is held by the substrate under an elasticity of the foamed plastics until the adhesive mortar is set. The artificial stone is prevented by such provisional fixation from scaling off or falling off and there by production is facilitated.

20 Claims, 4 Drawing Sheets

OUTDOOR STRUCTURE SUCH AS GATE POST, GATE WING OR FENCE

BACKGROUND OF THE INVENTION

1. Field of the Invention

The present invention relates to an outdoor structure such as gate post, gate wing or fence.

2. Description of the Related Art

Such outdoor structures have conventionally been constructed by adhesively placing tiles, natural stones, artificial stones etc. on an inorganic substrate such as concrete substrate or mortar substrate using, for example, mortar adhesion substantially according to the traditional method for adhesive placement of them on an outer wall of a building. For example, when the tiles are adhesively placed on the mortar substrate, the mortar substrate is formed on its surface with protruding rib destined to be engaged with corresponding ridge formed on a rear surface of each tile so that the desired adhesive placement may be effectively assisted by such engagement serving as provisional fixation means.

However, mass production of the outdoor structure such as gate post, gate wing or fence comprising the inorganic substrate and said artificial stones adhesively placed thereon would require a crane for transport and installation thereof because the structure constructed in a plant will be inconveniently bulky and heavy. In view of work efficiency, there has been a serious demand for the outdoor structure of light weight.

As is well known, the tiles are usually obtained by cutting extruded long molding followed by sintering treatment and can be easily formed on their rear surfaces with the ridges cooperating with the protruding rib formed on the mortar substrate. On the other hand, the artificial stones are usually obtained by casting mortar or the like into various sizes as well as shapes and can not be easily formed with the ridges or the like with sufficient accuracy to be used as the provisional fixation means. In addition, the artificial stones obtained by casing of mortar are relatively heavy and apt to scale or fall off from the substrate during the adhesive placement under their dead loads. If, to avoid such falling off, the substrate is laid down so that its side on which the artificial stones will be adhesively placed may horizontally extend, the production efficiency would be unacceptably reduced, because the operator must wait for setting of the adhesive agent before the next side of the same substrate can be worked.

SUMMARY OF THE INVENTION

In view of the problem as has been described above, it is a principal object of the invention to provide an outdoor structure such as gate post, gate wing or fence and a method for constructing this so improved that the structure's weight can be reduced as significantly as possible, the adhesive placement of artificial stones can be achieved as efficiently as possible and the product can be adapted for mass production.

The object set forth above is achieved, according to an aspect of the invention, by an outdoor structure such as gate post, gate wing or fence comprising a substrate as a primary component made of foamed plastics not only contributing to weight reduction but also having an elasticity sufficient to retain anchoring members which are, in turn, easily attached to aritificial stones during molding of the latter, and said artificial stones being fixedly placed on the substrate by provisionally inserting them into the substrate and then adhesively fixing them in the final step. More specifically, the object set forth above is achieved, according to the invention, by an outdoor structure such as gate post, gate wing or fence comprising a substrate made of foamed plastics, a plurality of artificial stones fixedly placed on the surface of said substrate and a joint embedded in a gap defined between respective pairs of adjacent artificial stones, said outdoor structure being characterized by that said fixed placement is achieved by steps of provisionally fixing the artificial stones by piercing said substrate with said anchoring members partly projecting out from the rear surface and partly embedded in the respective artificial stones and adhesively fixing the rear surfaces of the respective artificial stones to the substrate.

Preferably, said substrate made of foamed plastics comprises a molding obtained by expansion molding its outer layer with a relatively low expansion ratio while expansion molding its inner part with a relatively high expansion ratio or a composite molding obtained by bonding two or more separate moldings together.

Preferably, said substrate made of foamed plastics comprises a pile such as a frame and a base layer of thick foamed plastics covering said pile.

Preferably, said anchoring member is made of metallic material or rigid plastics and provided with a seat disc.

Said anchoring member is provided on its part embedded in the artificial stone with the seat disc.

As will be readily understood from the foregoing description, the invention sufficiently reduces weight of the outdoor structure to be manually transported and installed without use of a crane. Provisional fixation of the artificial stones to the substrate made of foamed plastics which contributes to weight reduction and elastically retains the anchoring members allows the final adhesive fixation of the artificial stones to be reliably and firmly achieved while the artificial stones are maintained in their provisionally fixed position without an apprehension that they might scale off or fall off due to their dead loads, movement or vibration. The final adhesive fixation of the artificial stones can be thus carried out as efficiently as possible particularly in a manner suitable for mass production.

In addition, the outer layer expanded with a relatively low expansion ratio improves an elastic retaining force of the anchoring members and a reliability with which the artificial stones are provisionally fixed to the substrate.

Furthermore, the invention allows the anchoring members to be reliably and firmly assembled to the artificial stones.

DESCRIPTION OF THE PREFERRED EMBODIMENT

Figure 1:
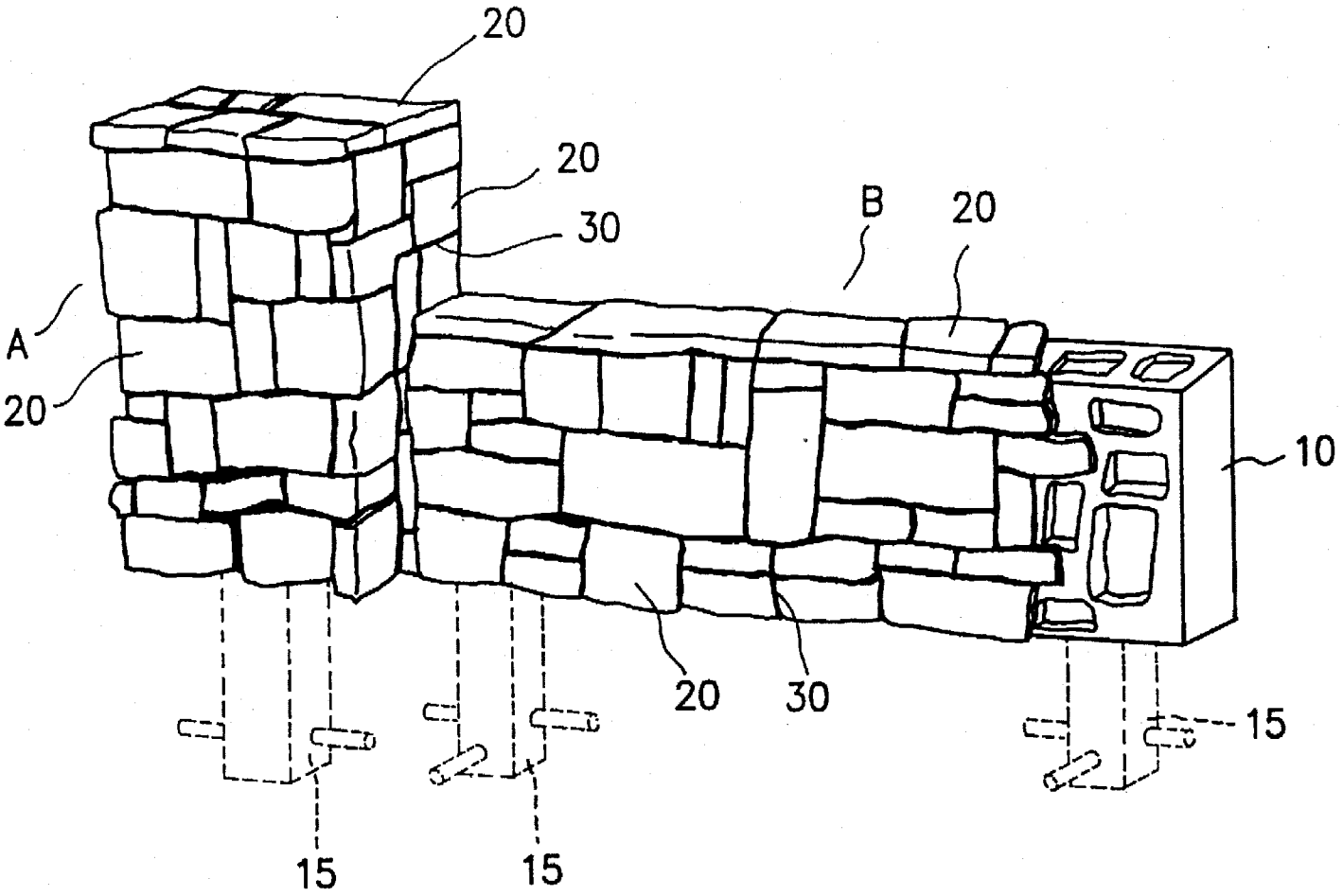
FIG. 1 is a perspective view showing a gate post and a fence, the latter being shown as partially broken away.
Figure 2:
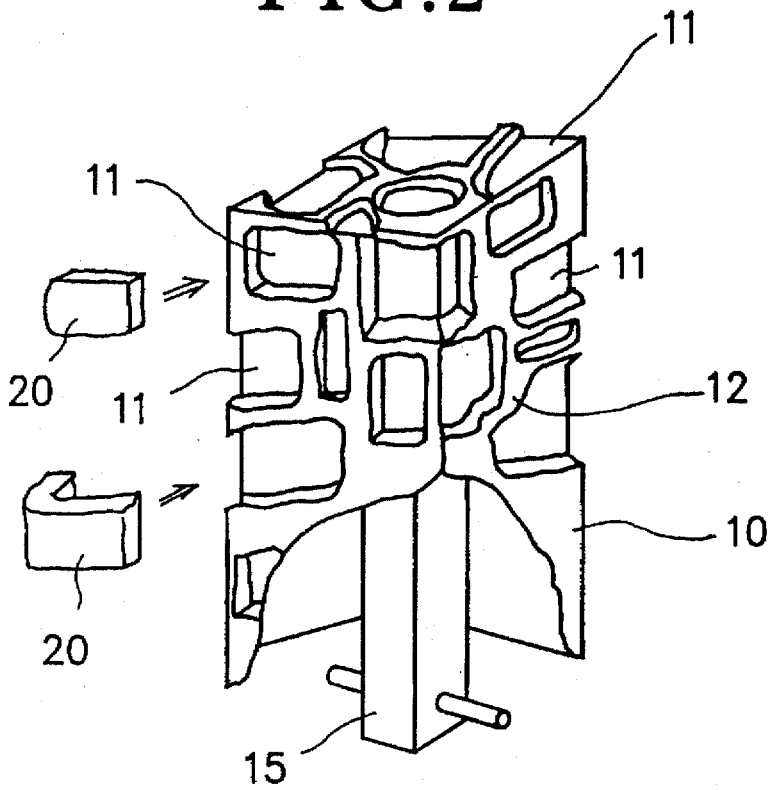
FIG. 2 is a perspective view showing a substrate of the gate post as partially broken away.
Figure 3:
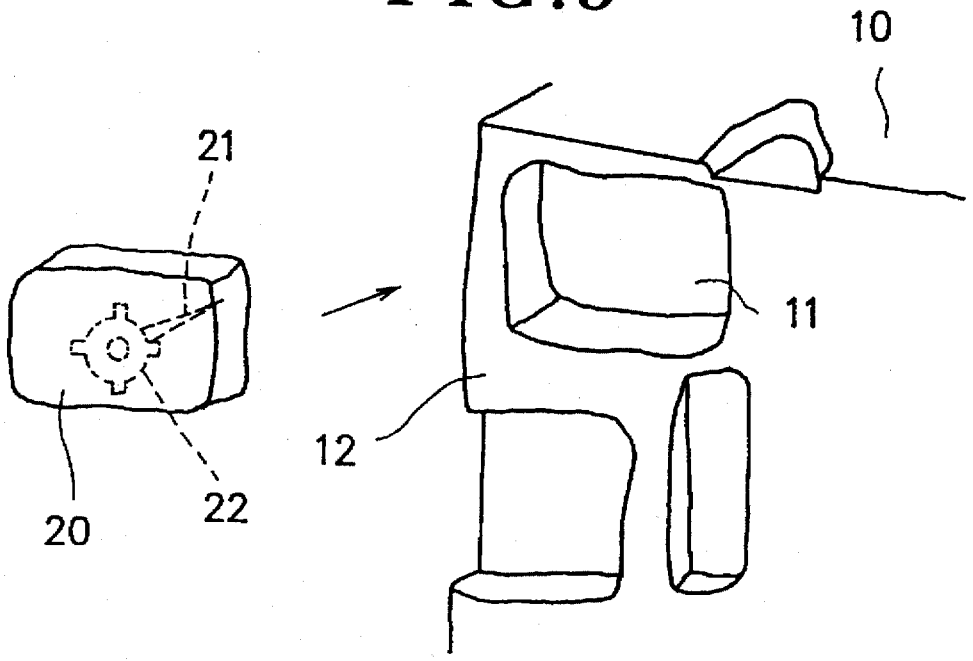
FIG. 3 is a scale-enlarged fragmentary perspective view illustrating a relationship between the substrate and the artificial stone.
Figure 4:
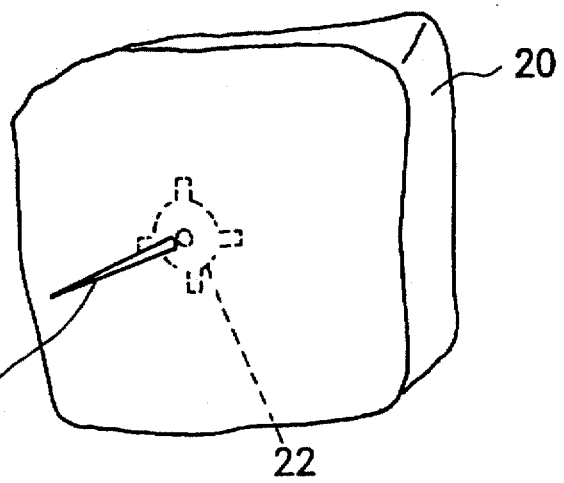
FIG. 4 is a perspective view of an artificial stone as viewed from its rear side.
Figure 5:
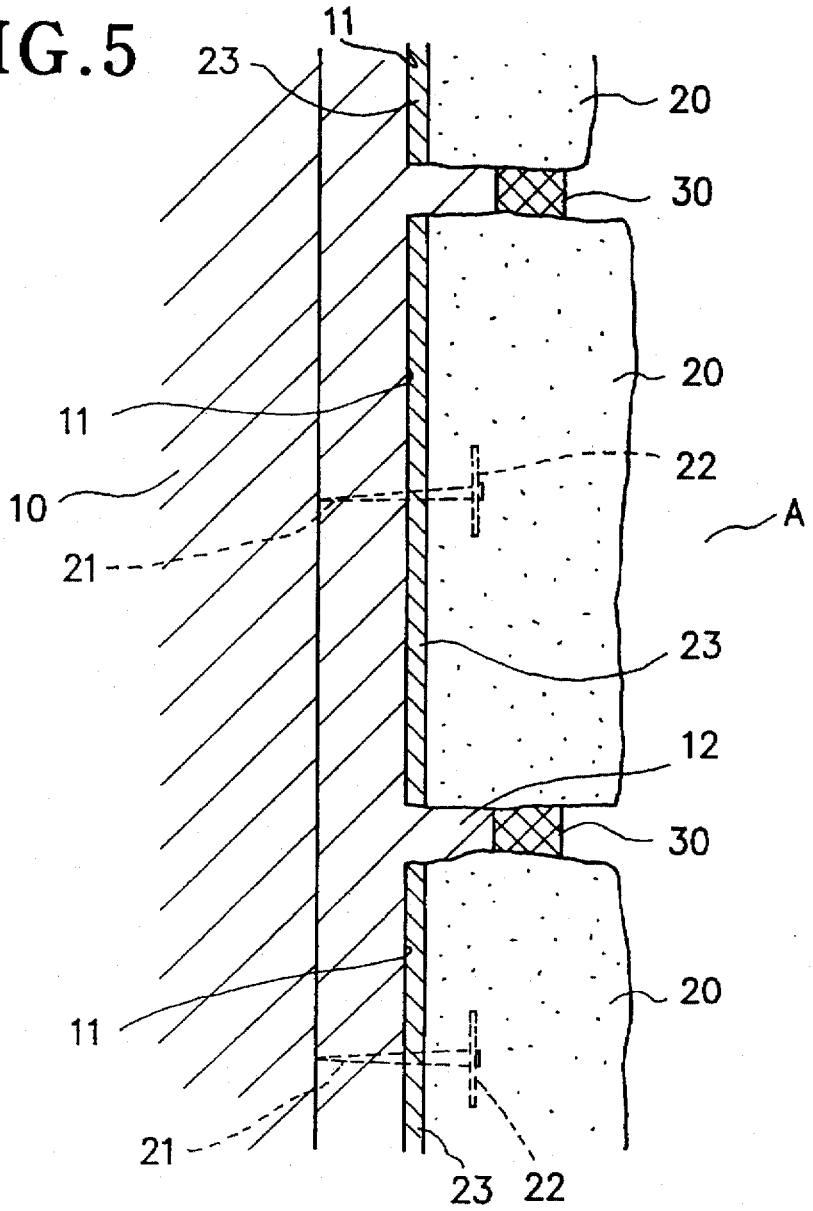
FIG. 5 is a scale-enlarged vertical sectional view showing a part of the gate post.

Details of the invention will be better understood from the following description of preferred embodiments made in reference with the accompanying drawings. Reference letter A designates a gate post and reference letter B designates a fence butt-jointed to said gate post A. The gate post A or the fence B comprises a plurality of artificial stones 20, a substrate 10 made of foamed plastics into which said artificial stones 20 are adhesively inserted, and joint 30 disposed between respective pairs of adjacent artificial stones 20 inserted into said substrate 10 so as to form a unit destined to be fixedly installed on the ground surface.

The substrate 10 is molded with a relatively low expansion ratio in the outer layer and with a relatively high expansion ratio in the inner part thereof. For example, the substrate 10 may be a solid molding obtained by expanding polystyrene plastics with two different expansion ratios, i.e., with an expansion ratio of 10 in the outer layer having a thickness of 1 to 2 cm and with an expansion ratio of 50 in the inner part so that the desired weight reduction of the substrate 10 may be assured and the relatively rigid outer layer may have a sufficient elastic retaining force for the anchoring member such as a nail as will be described later more in detail.

The substrate 10 may be dimensioned, for example in the case of the gate post A, to be 45 cm in width as well as depth and 1 to 2 m in height. In the case of the fence B, the substrate 10 may be dimensioned, for example, to be 1 m in width, 20 cm in depth and 60 cm in height. Means for installation of the substrate may be selected from a wide range and, for example, there may be provided a pile destined to be buried in the ground and the substrate may be attached thereto. Such pile is preferably made of metallic material such as aluminium for stability with which the substrate is installed. In the embodiment illustrated, there is centrally provided a single pile[15] for the gate post and there are provided two piles[15] on longitudinally opposite sides for the fence B.

According to this embodiment, the substrate 10 is provided over its entire surface except its bottom surface with artificial stone receiving recesses 11 and a protruding rib 12 bordering or defining these receiving recesses 11, these receiving recesses 11 and the protruding rib 12 are molded with a relatively low expansion ratio integrally with the substrate 10. The artificial stone receiving recesses 11 are configured in conformity with outer shapes of the artificial stones 20 which are molded in a predetermined number of different shapes as will be described later more in detail. The protruding rib 12 has a height lower than an average thickness of the artificial stones 20 as will be described later, for example, a height of 1 cm.

These artificial stones 20 are molded from mortar in predetermined number of different shapes and colored like natural stones. According to this embodiment, fixation of the artificial stone to the substrate 10 is achieved by a provisional procedure of piercing said substrate 10 with an anchoring member 21 in the form of a nail and a final adhesive fixation by adhesively fixing the rear surface of the artificial stone 20 to the substrate 10. According to this embodiment, the anchoring member 21 comprises a seat disc 22 embedded in the artificial stone 20 and a nail projecting out from said seat disc 22 through a rear surface of the artificial stone.

According to this embodiment, the artificial stones 20 are moldings having different shapes, which are plural but of limited number, and an average thickness of about 3 cm. Each of the artificial stones 20 is provided with the anchoring member 21 comprising, in the embodiment, a seat disc 22 embedded in the artificial stone 20 and a single nail projecting out from the rear surface of the artificial stone 20 by 15 to 20 mm, preferably by 20 mm.

The seat disc 22 comprises a plate of rigid plastics provided with a plurality of through-holes so as to be reliably embedded in the artificial stone 20. The anchoring member 21 in the form of the nail is embedded in the artificial stone 20 during molding of the artificial stone 20 so that the nail head may be fixed to the rear surface of said seat disc 22 and the nail 21 projects out from the center of the seat disc 22.

Fixation of the artificial stone 20 to the substrate 10 is achieved by applying adhesive mortar 23 to the surface of the substrate 10 and/or the rear surface of the artificial stone 20, pressing the artificial stone 20 against the substrate 10 and thereby piercing the substrate 10 with the anchoring member 21 projecting out through the rear surface of the artificial stone 20. The artificial stone 20 is thereby provisionally fixed until the adhesive mortar 23 is set whereupon the artificial stone 20 is adhesively fixed to the substrate 10 by adhesion of the rear surface to the substrate 10. In other words, fixation of the artificial stone 20 is achieved by two stages, i.e., the provisional fixation by insertion of the anchoring member 21 and the final adhesive fixation.

The provisional fixation by means of the anchoring member 21 in the form of the nail allows the adhesive mortar 23 to be reliably set without an apprehension that the artificial stones might be shifted during the process of setting, because the substrate 10 made of foamed plastics elastically holds the nail 21 penetrating this substrate 10 and thereby reliably holds the artificial stone 20 of mortar, which is relatively heavy, so that the artificial stone 20 may be reliably prevented from scaling off or falling off due to their dead loads, movement, vibration etc. This preferable effect is achieved also because the outer layer of the substrate 10 molded with a relatively low expansion ratio improves an elastic hold for the anchoring member 21 and further enhance the ability of reliably holding the artificial stone 20 without an apprehension of scaling off or falling off thereof.

The surface of the substrate 10 is formed with said artificial stone receiving recesses 11 in conformity with the shapes, the number and the arrangement and the artificial stones 20 are inserted into the corresponding receiving recesses 11 so as to achieve said provisional fixation by the anchoring member 21 and adhesive fixation. As a result, the effect of said anchoring member 21 cooperates with the insertion of the artificial stones 20 into the corresponding receiving recesses 11, the latter being assisted by an elastic holding force by the protruding rib 12 to achieve further reliable fixation of the artificial stones 20.

There is provided a joint 30 formed by embedding joint mortar in a gap defined between respective pairs of adjacent artificial stones 20 and supported by the underlying rib 12 serving here as a joint base. Height of the joint 30 is dimensioned to have a height above said protruding rib 12 smaller than said average thickness 3 cm of the artificial stones 20. By utilizing the protruding rib 12 having a height of 10 mm as the joint base, a necessary amount of the joint mortar can be saved and thereby weight of the gate post A or the fence B can be further reduced.

The gate post A or the fence B is produced by a method comprising steps of applying adhesive mortar to the artificial stone receiving recesses 11 and/or the artificial stones 20 corresponding to said receiving recesses 11 in their shapes; provisionally fixing the artificial stones 20 by inserting the artificial stones 20 into the receiving recesses 11 with the rear sides of the former being pressed against the latter while piercing the substrate 10 with the anchoring member 11; forming the joint by embedding the joint mortar with said artificial stones 20 being maintained in their provisionally fixed positions; and setting said adhesive mortar 23 as well as said joint mortar for final adhesive fixation of the artificial stones.

The artificial stones 20 are molded in a plurality of different shapes and therefore the provisional fixation of the artificial stones 20 must be to the receiving recesses 11 respectively paired with the artificial stones 20. To facilitate the operator to identify the respective paired stones and recesses, identical marks may be pressed in each paired stone 20 and recess 11 during or after their molding so that the operator may identify locations of the respective artificial stones 20 and then start the step of application of the adhesive mortar.

Figure 6:
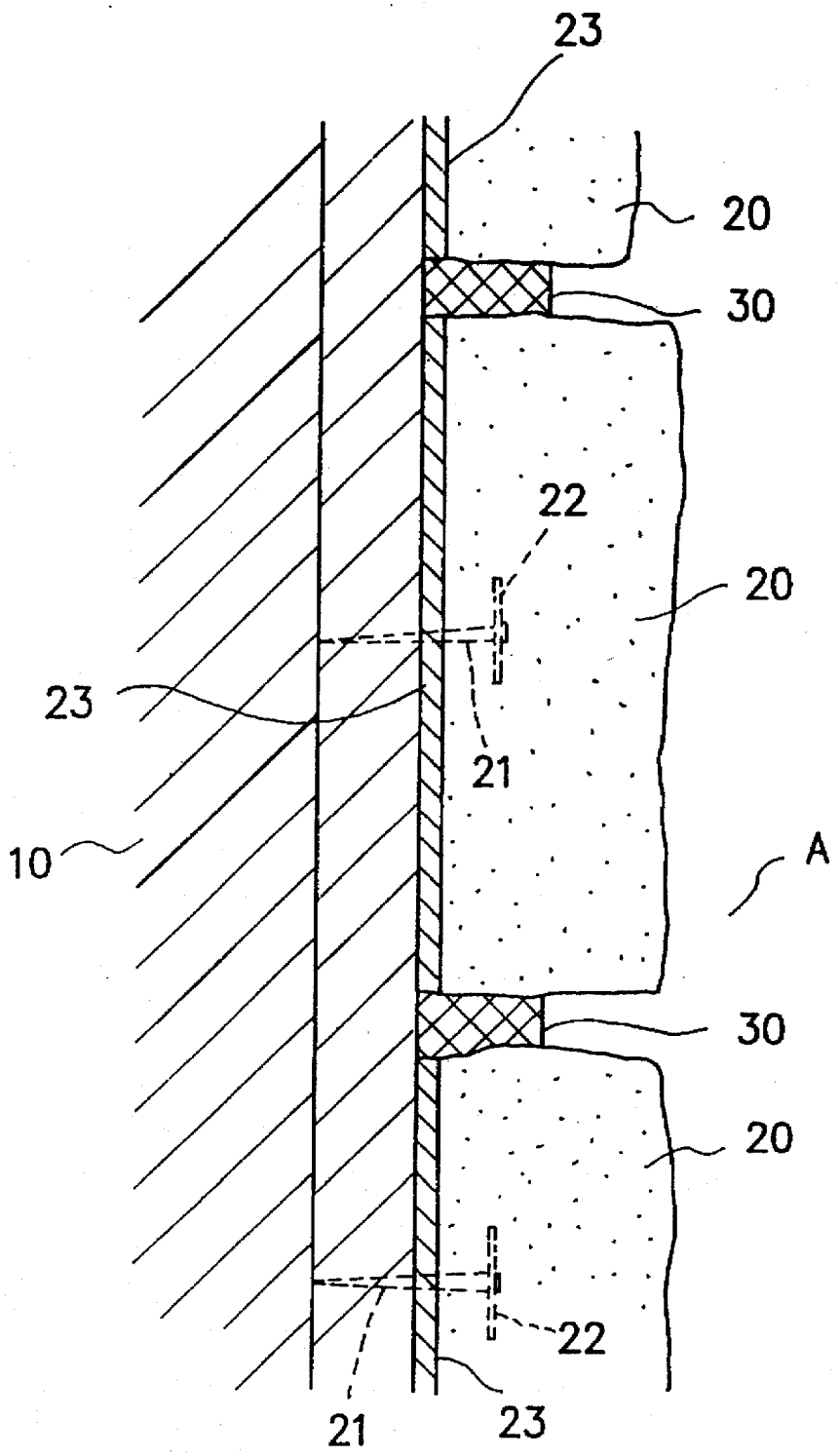
FIG. 6 is a view similar to FIG. 5 showing a variant of the gate post.

FIG. 6 shows a variant of the invention, according to which the substrate 10 has neither said artificial stone receiving recesses 11 nor said protruding rib 12 and the artificial stones 20 are fixed on the flat surface of the substrate 10. In this variant, provisional fixation of the artificial stones 20 is achieved only by insertion of the anchoring members 21 into the substrate 10 so as to prevent the artificial stones 20 from scaling off or falling off. The remainder of the arrangement is similar to the previous embodiment. The parts similar to those in the previous embodiment are designated by the similar reference numerals in FIG. 6 and will not be described further.

It should be understood here that the invention is not limited to the embodiment as has been described hereinabove in reference with the accompanying drawings. For example, the artificial stones may be moldings of rigid plastics. The previously mentioned anchoring member having a single nail may be replaced by an anchoring member made of metallic material or rigid plastics comprising a plurality of nails and a seat disc. The substrate may be a single molding of foam plastics or a composite molding comprising a plurality of moldings bonded together, or may be formed by a pile such as a frame and a base layer of thick foamed plastics covering the pile. Expansion ratio of foam plastics may be selected from a wide range and, if desired, an expansion ratio may be common to the outer layer and the rest of the substrate. The protruding rib and the artifical stone receiving recesses may be post-attached to a thin-board-like molding of foam plastics or a meshy molding of foam plastics defining the protruding rib may be post-attached to the substrate. Adhesive agent other than the adhesive mortar may be also used for adhesive fixation of the artificial stones. Moldings configurated in conformity with a pattern of the joint may be also used as the joint material and embedded into the gap defined between the respective pairs of adjacent artifical stones so as to be supported by the underlying rib. The invention is applicable to the various outdoor structures other than the gate post and the fence, for example, the gate wing. It should be understood that, without departing from the scope and the spirit of the invention, there can be provided many variations and/or modifications in the specific arrangement, configuration, material, number, dimension and their mutual relationship of the artificial stones, the protruding rib, the artificial stone receiving recesses, the anchoring members, if they are employed, the marks provided on the artificial stones and the receiving recesses, also if they are employed, and the specific steps for production thereof.

What is claimed is:

1. A structure comprising:

a substrate made of elastic foamed plastic material;

a plurality of artificial stones fixedly placed on the substrate;

at least one anchoring member including a part embedded within each of the artificial stones and another part projecting out therefrom;

the artificial stones being provisionally fixed to a surface of the substrate by piercing the substrate with the at least one anchoring member; and an adhesive applied between the substrate and the artificial stones to finally and adhesively fix the artificial stones to the substrate.

2. The structure as claimed in claim 1, further comprising a joint embedded in a gap defined between respective pairs of adjacent artificial stones.

3. The structure as claimed in claim 1, wherein the at least one anchoring member includes a tip which pierces the substrate, the at least one anchoring member not penetrating completely through the substrate, and the tip being anchored within the substrate.

4. The structure as claimed in claim 1, further comprising a pile defining a core of the structure, said substrate covering the pile.

5. The structure as claimed in claim 4, wherein said pile is buriable in the ground.

6. The structure as claimed in claim 1, wherein the at least one anchoring member is made of metallic material or plastics and has a seat disc attached to an end thereof.

7. The structure as claimed in claim 1, wherein said part of said anchoring member embedded in each of said artificial stones terminates in a seat disc.

8. A structure comprising:

a substrate made of elastic foamed plastic material, said substrate having an outer part of elastic foamed plastic material and an inner part of elastic foamed plastic material, said outer part having a lower expansion ratio than the inner part, the outer part being more rigid than the inner part and the inner part being lighter than the outer part;

a plurality of artificial stones fixedly placed on the substrate;

at least one anchoring member including a part embedded within each of the artificial stones and another part projecting out therefrom;

the artificial stones being provisionally fixed to a surface of the substrate by piercing the substrate with the at least one anchoring member; and an adhesive applied between the substrate and the artificial stones to finally and adhesively fix the artificial stones to the substrate.

9. The structure as claimed in claim 8, further comprising a joint embedded in a gap defined between respective pairs of adjacent artificial stones.

10. The structure as claimed in claim 8, wherein the anchoring member is retained within the outer part of the substrate.

11. The structure as claimed in claim 8, wherein the at least one anchoring member is retained within the outer part and the inner part of the substrate.

12. The structure as claimed in claim 8, wherein the adhesive is applied between a rear surface of the artificial stones and a surface of the outer part of the substrate to finally and adhesively fix the artificial stones to the substrate.

13. The structure as claimed in claim 8, wherein the outer part of elastic foamed plastic material is thinner than the inner part of elastic foamed plastic material.

14. The structure as claimed in claim 8, wherein the at least one anchoring member includes a tip which pierces the substrate, the at least one anchoring member not penetrating completely through the substrate, and the tip being anchored within the substrate.

15. The structure as claimed in claim 8, wherein the outer part of elastic foamed plastic material and the inner part of elastic foamed plastic material are integrally molded.

16. The structure as claimed in claim 8, wherein the outer part of elastic foamed plastic material is molded and the inner part of elastic foamed plastic material is molded, the outer part and the inner part being bonded together.

17. The structure as claimed in claim 8, further comprising a pile defining a core of the structure, said substrate covering the pile.

18. The structure as claimed in claim 17, wherein said pile is buriable in the ground.

19. The structure as claimed in claim 8, wherein the at least one anchoring member is made of metallic material or plastics and has a seat disc attached to an end thereof.

20. The structure as claimed in claim 8, wherein said part of said anchoring member embedded in each of said artificial stones terminates in a seat disc.

* * * * *